US011062860B2

(12) United States Patent
Arderiu Costas et al.

(10) Patent No.: US 11,062,860 B2
(45) Date of Patent: Jul. 13, 2021

(54) ELECTRICAL SWITCH

(71) Applicant: SIMON, S.A.U., Barcelona (ES)

(72) Inventors: Jordi Arderiu Costas, Barcelona (ES); Adrià Riquè Rebull, Barcelona (ES); Salvi Plaja Miró, Barcelona (ES); Clara Batiste Mayas, Barcelona (ES)

(73) Assignee: SIMON, S.A.U., Barcelona (ES)

( * ) Notice: Subject to any disclaimer, the term of this patent is extended or adjusted under 35 U.S.C. 154(b) by 207 days.

(21) Appl. No.: 16/304,999

(22) PCT Filed: Jun. 1, 2017

(86) PCT No.: PCT/ES2017/070388
§ 371 (c)(1),
(2) Date: Nov. 27, 2018

(87) PCT Pub. No.: WO2017/207856
PCT Pub. Date: Dec. 7, 2017

(65) Prior Publication Data

US 2020/0335291 A1 Oct. 22, 2020

(30) Foreign Application Priority Data

Jun. 2, 2016 (ES) ..... ES201630732

(51) Int. Cl.
*H01H 23/14* (2006.01)
*H01H 3/02* (2006.01)
(Continued)

(52) U.S. Cl.
CPC ..... *H01H 23/14* (2013.01); *H01H 3/02* (2013.01); *H01H 13/50* (2013.01); *H01H 21/22* (2013.01); *H01H 2221/016* (2013.01)

(58) Field of Classification Search
CPC ..... H01H 23/14; H01H 3/02; H01H 13/50; H01H 21/22
(Continued)

(56) References Cited

U.S. PATENT DOCUMENTS 5,892,192 A 4/1999 Ishiguro et al.
2010/0124962 A1* 5/2010 Chudek ..... G07F 17/32 463/13

FOREIGN PATENT DOCUMENTS

DE 2060752 A1 6/1972

OTHER PUBLICATIONS

International Search Report dated Oct. 30, 2017 re: Application No. PCT/ES2017/070388, pp. 1-3, citing: US 2010/0124962 A1, DE 20 60 752 A1 and US 5 892 192 A.
(Continued)

*Primary Examiner* — Edwin A. Leon
*Assistant Examiner* — Iman Malakooti
(74) *Attorney, Agent, or Firm* — Cantor Colburn LLP

(57) ABSTRACT

The invention relates to an electric switch defining a front surface and including at least two rocker keys, which rock about a corresponding rocker axis, and at least one base provided with at least two operating points for electrical connection and disconnection located at a point corresponding to the center of the corresponding key, where the rocking of the keys presses on the corresponding at least one operating point and causes the electrical connection or disconnection, wherein the key comprises has two sections separated by the rocker axis, a first transmission section of the operating force and a second section that does not transmit the operating force to the operating point, and in that the rocker axes of the at least two keys are parallel to each other.

7 Claims, 4 Drawing Sheets

(51) Int. Cl.
*H01H 13/50* (2006.01)
*H01H 21/22* (2006.01)

(58) Field of Classification Search
USPC ..... 200/339
See application file for complete search history.

(56) References Cited

OTHER PUBLICATIONS

Written Opinion dated Oct. 20, 2017 re: Application No. PCT/ES2017/070388, pp. 1-5, citing: US 2010/0124962 A1, DE 20 60 752 A1 and US 5 892 192 A.

* cited by examiner

ELECTRICAL SWITCH

TECHNICAL FIELD

The present disclosure relates to an electric switch, particularly an electric switch comprising a rocker key.

BACKGROUND

Electric switches known today comprise a key assembled on a base provided with an operating point, wherein said rocker key rocks about a axis. This key defines two positions: a first contact or electrical connection position and a second disconnection or standby position.

From this second standby position, when the user presses the key it transitions to the first contact position where it can be kept, or if desired it can automatically return to the second position, for example by means of a spring. When this automatic return occurs, every time the key is pressed, the electrical contact will be connected or disconnected in an alternating manner.

If desired, more than one key can be arranged on one and the same base, and a frame can be arranged around the key or keys.

These keys normally rock with respect to an axis located in the middle of same, since the point of electrical connection is also normally located in the middle of same. This is because it is advisable for electric switches to have standard parts the arrangement of which does not depend on the assembly position, such that the largest possible number of parts can be used for switches that can be assembled with different orientations.

However, these electric switches comprising a rocker key with respect to a central axis have several drawbacks. First, the surface of the key the user must press for connection or disconnection is half the useful surface of the key, and if the other half is pressed, the connection or disconnection will not take place because the key will not rock. This can be uncomfortable for the user.

Furthermore, if several keys are arranged next to one another in one and the same conventional switch, these keys are arranged with their rocker axes aligned with one another.

BRIEF SUMMARY

The disclosure provides an electric switch in which the useful surface of the key that the user can press for connection or disconnection is maximized.

The disclosure also provides an electric switch that allows its parts to be identical regardless of the orientation in which the switch has been assembled, keeping the point of connection in a central position.

The disclosure further provides an electric switch comprising a plurality of keys, the separation being minimal, wherein said separation is only for the purpose of preventing friction between keys.

More particularly, in a non-limiting exemplary embodiment, the disclosed electric switch defines a front surface and comprises:

- at least one rocker key, which rocks about a corresponding rocker axis,
- and at least one base provided with at least one operating point for electrical connection and disconnection located at a point corresponding to the center of the key, where the rocking of the key presses the corresponding at least one operating point and causes the electrical connection or disconnection, and is characterized in that the key comprises two sections separated by the rocker axis, a first section for the direct transmission of the operating force and a second portion that does not transmit the operating force to the operating point, wherein this second section of the key comprises a surface taking up less than 5% of the total front surface. According to a preferred embodiment, the second section of the key has a surface taking up less than 2% of the total front surface, for example the key only has a section for the transmission of the operating force, which takes up the 100% of the surface of the key.

Furthermore, the electric switch according to the present disclosure can comprise a plurality of rocker keys each with a corresponding rocker axis, wherein at least two rocker axes of at least two keys are parallel to one another.

Advantageously, the base comprises at least one operating point associated with a key, and said operating point is preferably located under the center of the corresponding key.

Each key can take up half of said front surface or less, and the keys of said plurality of keys are preferably arranged in rows and in columns.

The following advantages are obtained with the electric switch according to the present disclosure:

- The operating surface of the key is virtually the entire key, which is more comfortable for the user since virtually the entire key can be pressed;
- When the switch comprises more than one key, allows arranging them very close to one another, with just a minimal gap to prevent friction;
- Since the operating point can be arranged in a central position, all the parts of the switch of the present disclosure can also can also be used when the switch are installed in any position;
- The force the user must apply to operate the switch is the same force applied with conventional switches, since the path traveled by the key is the same, but it allows the surface of the key that can be pressed to be larger.

BRIEF DESCRIPTION OF THE DRAWINGS

To better understand the foregoing, a set of drawings are attached in which a practical embodiment is depicted schematically and exclusively by way of non-limiting example.

DETAILED DESCRIPTION

The electric switch according to the present disclosure defines a front surface 1, and comprises one or more bases 2 and one or more keys 4, where each key is preferably the same size in the event that there is more than one.

It must be pointed out that the switch according to an embodiment of the disclosure is preferably of the type of switches mounted in walls at a low height, particularly intended for use below 1.20 m high, although it could also be installed at any suitable height.

Figure 1:
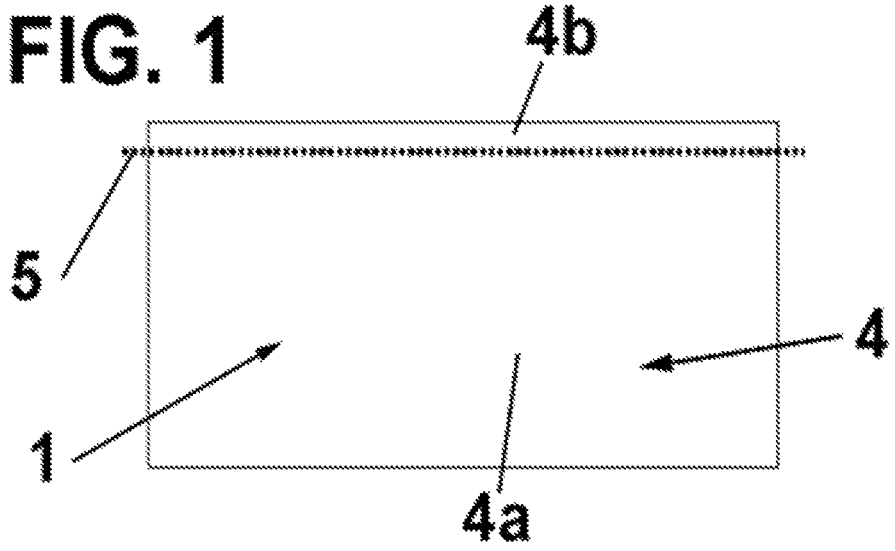
FIGS. 1 to 4 are front views of an electric switch of the present disclosure, according to several embodiments.
Figure 2:
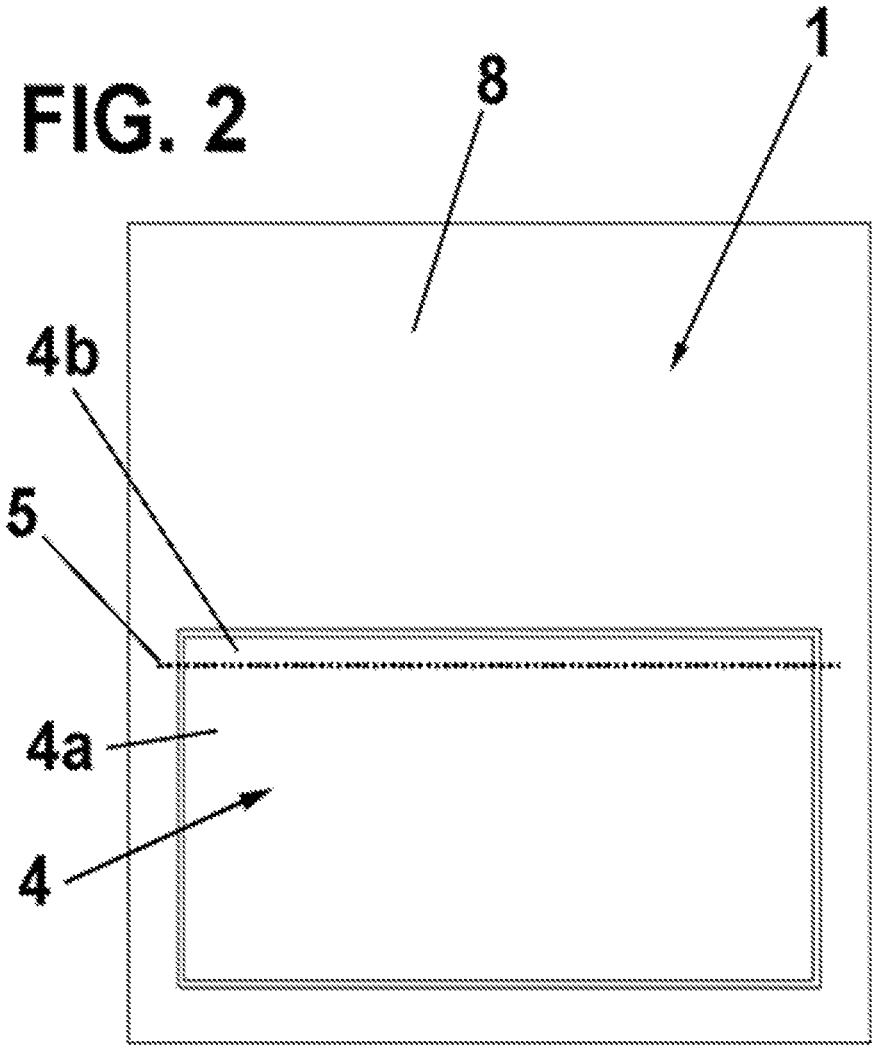
Figure 3:
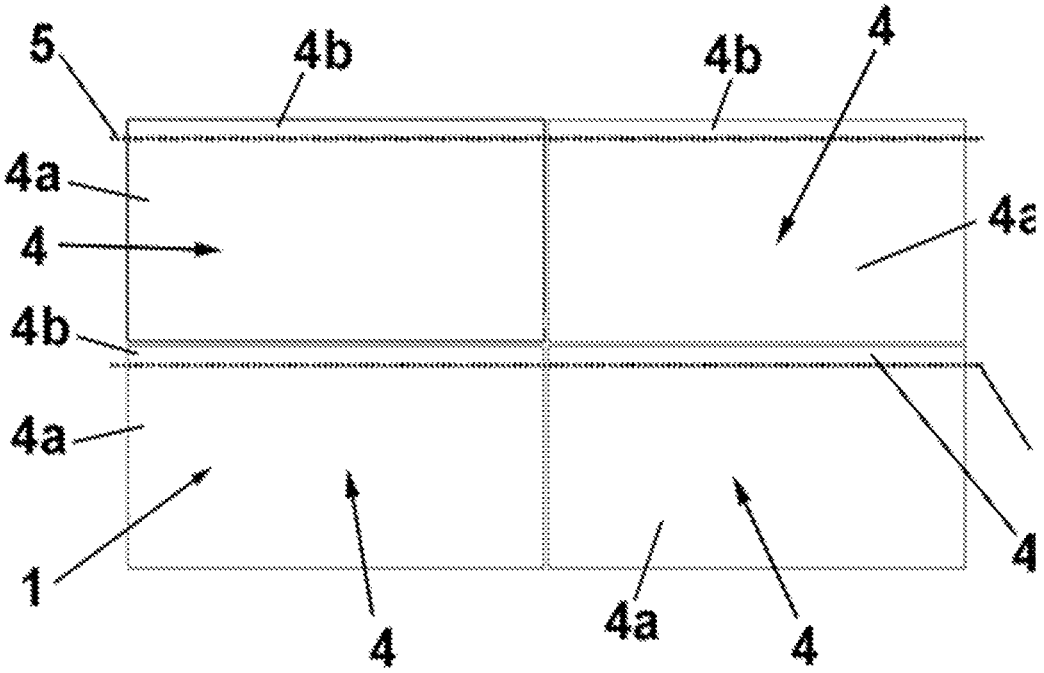
Figure 4:
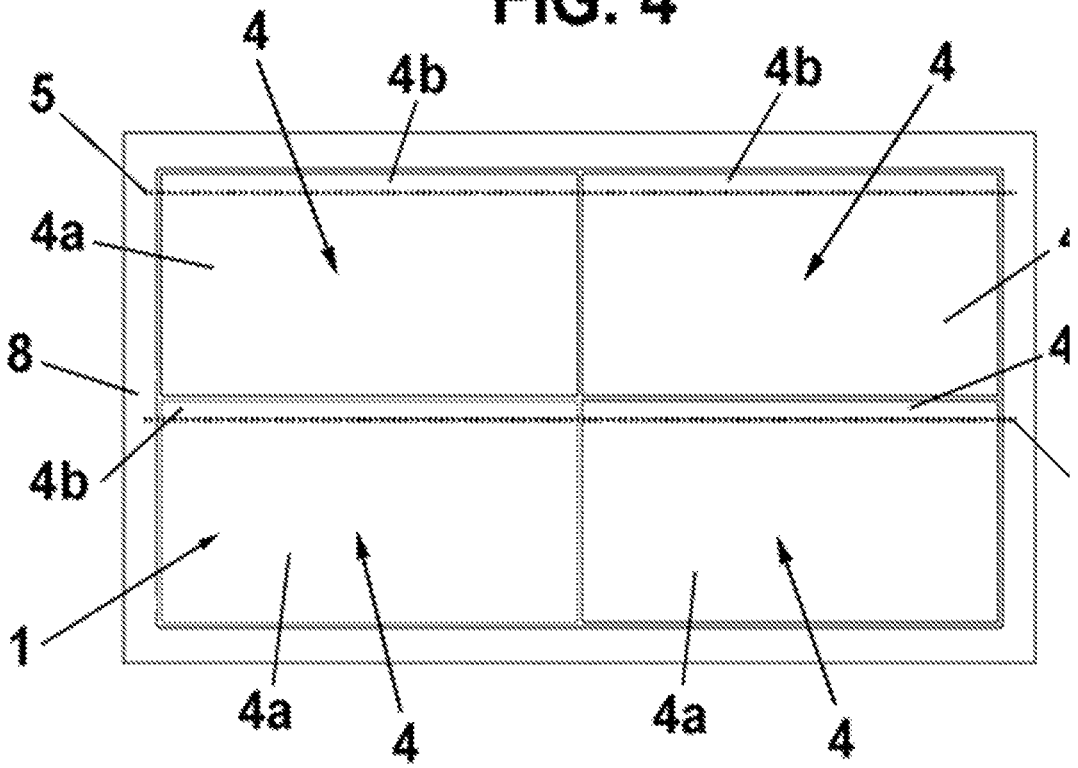

It should be pointed out that the front surface 1 defined by the electric switch according to the present disclosure can be defined as follows, according to its configuration:

one or more keys 4 without a frame (FIGS. 1 and 3);

one or more keys 4 with a frame 8 (FIGS. 2 and 4).

It should be indicated that the electric switch according to the present disclosure can comprise any number suitable of keys arranged next to one another, or forming rows and columns, although for the sake of simplicity only embodiments with two and four keys are depicted in the drawings.

Furthermore, said base 2, or each base 2, is provided with at least one operating point 3 for connection and disconnection, wherein each key 4, rocks with respect to a rocker axis 5, wherein the rocking of said key 4 presses said corresponding operating point 3 and causes the electrical connection or disconnection.

Said rocker axis 5 separates a first section 4*a* of the key for the transmission of the operating force from a second section 4*b* of the key, which does not transmit the operating force to the operating point 3, wherein this second section 4*b* of the key 4 comprises a surface taking up less than 5% of the total front surface 1.

It should be indicated that the second section 4*b* can take up a surface taking up about or less than 2% of the front surface 1, or the rocker axis 5 can even be arranged at an edge of the key 4, such that the first section 4*a* occupies substantially all of the key, wherein the second section 4*b* is inexistent.

Furthermore, in the event that the switch comprises more than one key, at least two of the rocker axes 5 of a switch are preferably parallel to one another, i.e., they are not aligned, as occurs in conventional electric switches with more than one key.

It should be indicated that the rocker axes 5 are indicated in FIGS. 1 to 4 in the upper part of the key 4, but they can be located interchangeably in the lower part of the key 4 or in any suitable position provided that it is moved with respect to the center of the front surface 1 of the switch.

As can also be seen in FIGS. 1 to 4, each key 4 takes up half of said front surface or less 1.

Figure 7:
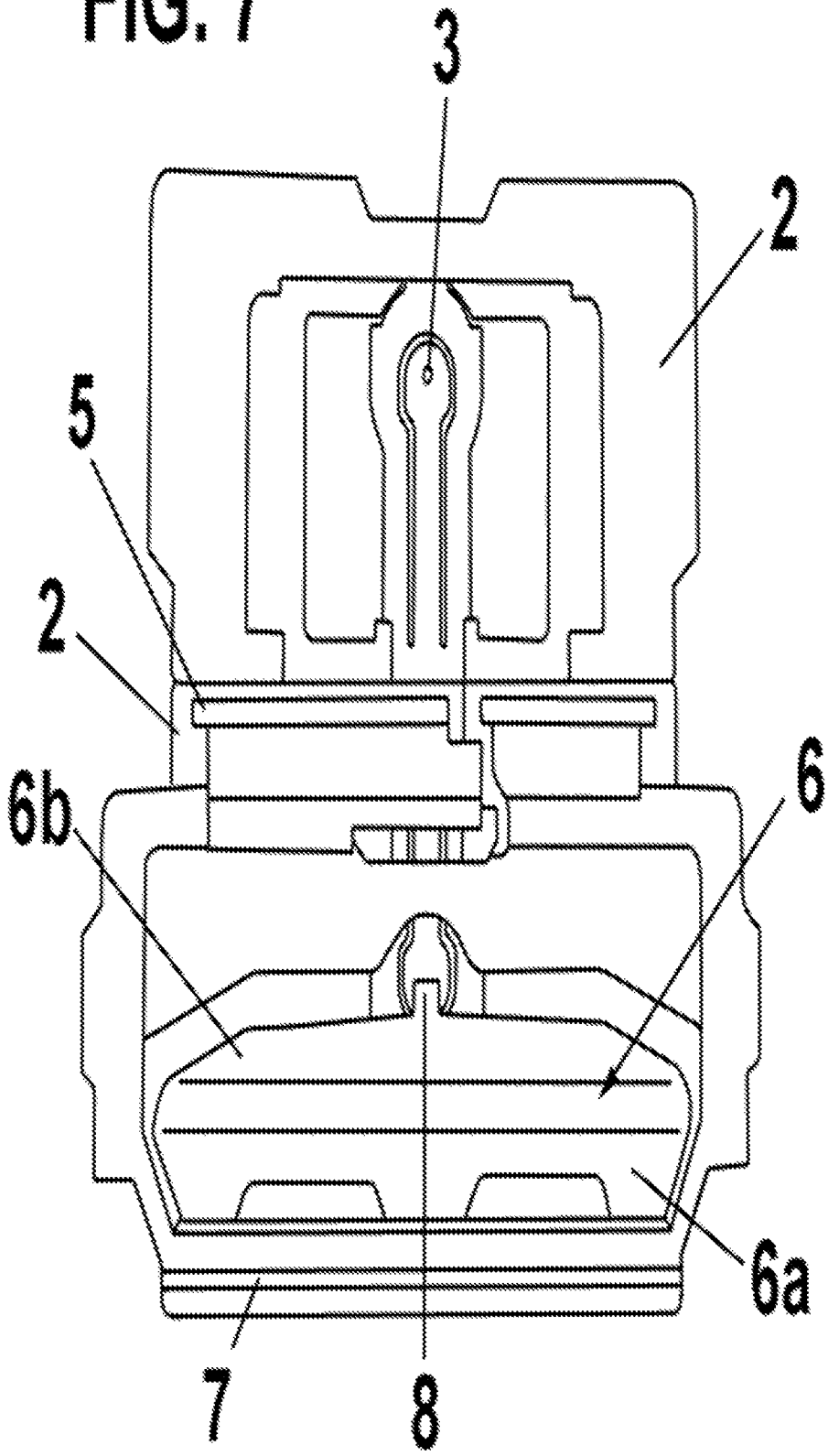
FIG. 7 is a plan view of the base of the electric switch of the present disclosure, comprising two bases.

Furthermore, each operating point 3 is located advantageously under the center of each key 4, as can be seen in FIG. 7.

It should be indicated that the operation of the switch according to the present disclosure can be done in any suitable manner, for example, by means of an electronic operating mechanism or by means of a conventional mechanical operating mechanism.

A possible mechanical operation of the switch according to the present disclosure, comprising an actuator 6, is described below exclusively by way of non-limiting example.

It should be indicated that an electric switch comprising two bases is depicted in FIG. 7. To allow seeing the actuator 6 and bases 2, the corresponding keys 4 have been removed in this drawing and the actuator 6 has been removed in the upper half.

Figure 5:
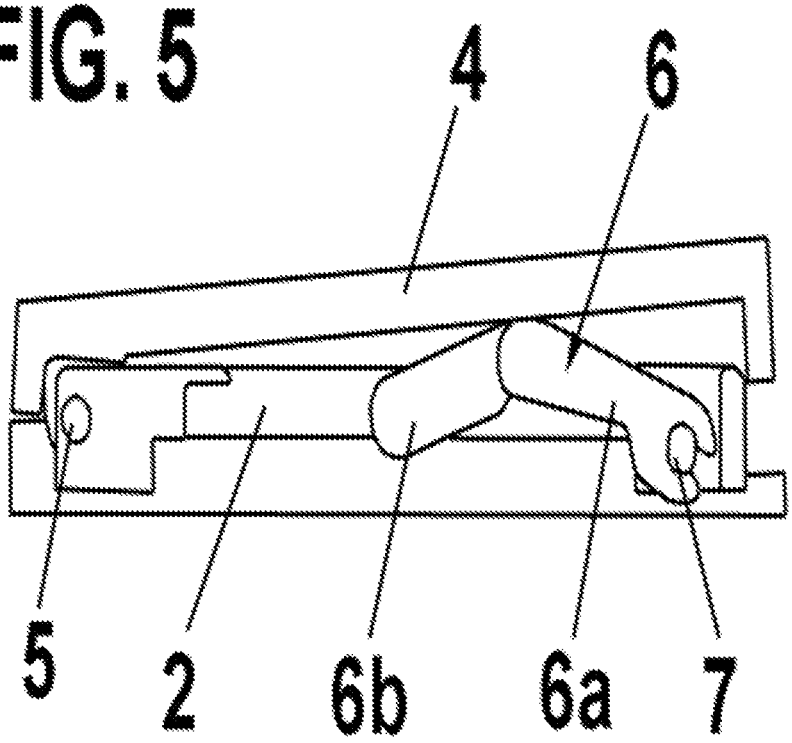
FIG. 5 is a sectional view of the electric switch of the present disclosure in its standby position.
Figure 6:
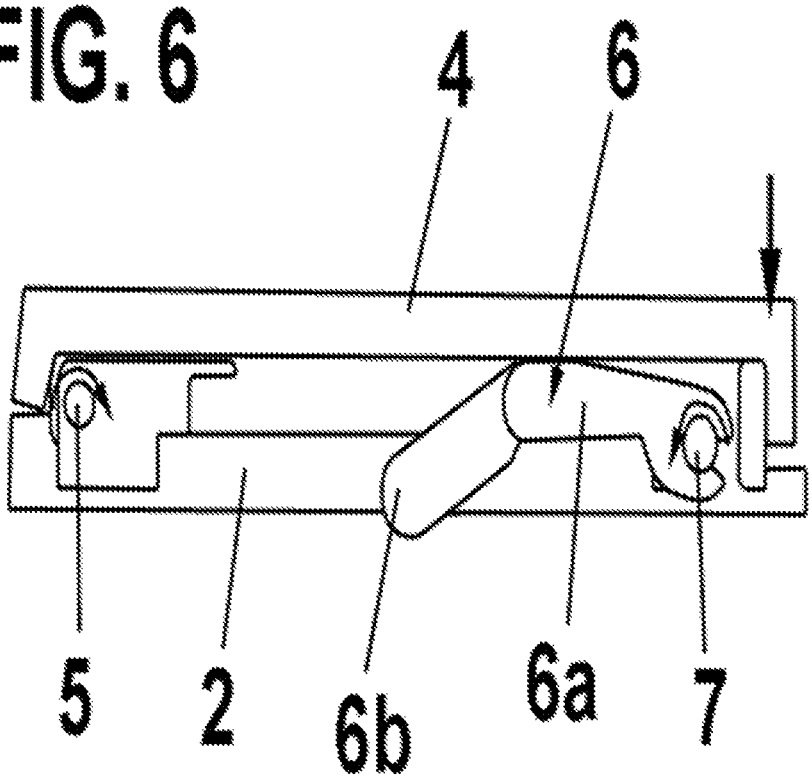
FIG. 6 is a sectional view of the electric switch of the present disclosure in its operating position.

It can be seen in FIGS. 5 and 6 that the base 2 comprises a key actuator 6 formed by a proximal segment 6*a* and a distal segment 6*b*, defining an angle greater than or equal to 90°. Furthermore, said proximal segment 6*a* of the actuator 6 comprises a rotating axis 7 at its end farthest away from the center of the front surface 1, and said distal segment 6*b* is in contact with the operating point 3 when said at least one key 4 is pressed.

As indicated above, with the electric switch according to the present disclosure the user has a larger surface for operating the switch, particularly almost the entire surface of the key 4, wherein several keys 4 can be arranged next to one another, with all the keys having the same size, unlike conventional electric switches, which have only half the surface of the key for operation thereof.

Despite having referred to a specific embodiment of the disclosure, it is evident for a person skilled in the art that the electric switch described is susceptible to a number of variations and modifications, and that all the mentioned details can be replaced with other technically equivalent details without departing from the scope defined by the attached claims.

The invention claimed is:

1. An electrical switch, defining a front surface and comprising:

at least two rocker keys, each rocker key having a corresponding rocker axis and wherein each rocker key rocks about the corresponding rocker axis, and at least one base provided with at least two operating points for electrical connection and disconnection, each located at a point corresponding to a center of the corresponding key, where the rocking of the keys presses on the corresponding at least one operating point and causes the electrical connection or disconnection, wherein the at least two rocker axes of the at least two keys are parallel to one another, said keys being arranged in a columns, wherein each key comprises two sections separated by said rocker axis, a first transmission section for transmitting an operating force and a second section that does not transmit the operating force to the operating point, wherein the second section of the keys has a surface taking up less than 5% of a total of the front surface; wherein the column extends in a direction perpendicular to the at least two rocker axes.

2. The electrical switch according to claim 1, wherein the second section of the keys has a surface taking up less than 2% of the total of the front surface.

3. The electrical switch according to claim 1, wherein the keys have edges and wherein one of the at least two rocker axes is located on one of the edges of the keys, such that the first section occupies substantially 100% of the surface of the keys.

4. The electrical switch according to of claim 1, wherein each key occupies half of said front surface or less.

5. The electrical switch according to claim 1, wherein the keys are arranged in rows and in the columns.

6. The electrical switch according to claim 1, wherein the second section of a key of the at least two rocker keys is touchable by a user of the electrical switch.

7. The electrical switch according to claim 1, wherein the second section of a first rocker key of the at least two rocker keys is located between:

an edge of the first section of a second rocker key of the at least two rocker keys, the edge being located opposite the rocker axis of the second rocker key, and the rocker axis of the first rocker key.

* * * * *